US006684491B1

(12) United States Patent
Vaillant

(10) Patent No.: US 6,684,491 B1
(45) Date of Patent: Feb. 3, 2004

(54) CONNECTOR PLUG EXTRACTION DEVICE FOR A DISC DRIVE

(75) Inventor: Philippe Vaillant, Grenoble (FR)

(73) Assignee: Seagate Technology LLC, Scotts Valley, CA (US)

( * ) Notice: Subject to any disclaimer, the term of this patent is extended or adjusted under 35 U.S.C. 154(b) by 0 days.

(21) Appl. No.: 09/539,597

(22) Filed: Mar. 31, 2000

Related U.S. Application Data

(60) Provisional application No. 60/158,842, filed on Oct. 12, 1999.

(51) Int. Cl.[7] ..... H01R 43/00

(52) U.S. Cl. ..... 29/764; 29/758; 29/747; 29/266; 294/15; 294/1.1

(58) Field of Search ..... 29/266, 747, 764, 29/758, 741, 761, 729, 278, 426.5; 294/15, 26; 81/420, 320; 248/444.1

(56) References Cited

U.S. PATENT DOCUMENTS

| | | | | | |
|---|---|---|---|---|---|
| 2,556,615 | A | * | 6/1951 | De Vaughn | 248/226 |
| 3,357,085 | A | * | 12/1967 | Martin | 29/239 |
| 3,452,976 | A | * | 7/1969 | Ross | 269/91 |
| 3,645,577 | A | * | 2/1972 | Peper | 294/104 |
| 3,828,402 | A | * | 8/1974 | Gorman | 24/81 PH |
| 3,844,013 | A | | 10/1974 | Hall, Jr. | 29/203 |
| 4,475,283 | A | | 10/1984 | Olseon et al. | 29/720 |
| 4,805,298 | A | * | 2/1989 | Takahashi | 29/764 |
| 4,817,274 | A | | 4/1989 | Higgins | 29/764 |
| 4,955,576 | A | * | 9/1990 | Moberg | 248/449 |
| 4,961,256 | A | | 10/1990 | Faillace | 29/764 |
| 4,970,779 | A | | 11/1990 | Chen | 29/764 |
| 5,040,289 | A | | 8/1991 | Flaynik | 29/764 |
| 5,046,237 | A | | 9/1991 | Conforti et al. | 29/764 |
| 5,152,052 | A | | 10/1992 | Rantala et al. | 29/764 |
| 5,448,814 | A | | 9/1995 | Fisher | 29/236 |
| 5,598,775 | A | * | 2/1997 | Vongfuangfoo et al. | 100/233 |
| 5,799,382 | A | | 9/1998 | Brameyer | 29/268 |
| 5,860,205 | A | | 1/1999 | Davis | 29/750 |
| 6,189,210 | B1 | * | 2/2001 | Cox et al. | 29/861 |

FOREIGN PATENT DOCUMENTS

JP 10-243868 * 9/1998

* cited by examiner

*Primary Examiner*—Peter Vo
*Assistant Examiner*—Minh Trinh
(74) *Attorney, Agent, or Firm*—Westman, Champlin & Kelly, P.A.

(57) ABSTRACT

An extraction device for removing a connector plug from a disc drive socket including first and second lever plates having a length extending between opposed first and second ends and a width extending between opposed sides and the first and second lever plates being pivotally connected between the first and second ends to form lever handles and lever arms. The lever arms include opposed fingers spaced along the width of the lever plates between opposed sides. The lever arms include a slot between fingers, a width of which is sized to enclose a length of the connector plug. A spring biases the lever arms of the first and second lever plates towards one another and the lever plates being movable against a spring bias to open the lever arms to remove a connector plug. A method for removing a connector from a disc drive socket including aligning an extraction device with the connector plug and operating the device to remove the connector plug.

15 Claims, 6 Drawing Sheets

CONNECTOR PLUG EXTRACTION DEVICE FOR A DISC DRIVE

CROSS-REFERENCE TO RELATED APPLICATION

The present invention claims priority to Provisional Application Serial No. 60/158,842 filed Oct. 12, 1999 and entitled "GRIPPER FOR CONTROLLED REMOVAL OF ONE SIDE OF A MULTI-LINE ELECTRICAL COUPLING.

FIELD OF THE INVENTION

The present invention relates to a data storage device. In particular, the present invention relates to an extraction device for a data storage system.

BACKGROUND OF THE INVENTION

Data storage systems store digital information on magnetizable discs. Data storage systems are connected to a host system to provide operating power and to read data from and write data to discs. Power and operating commands are transmitted from the host system to the data storage system and data is transmitted to the host system via connectors. Connectors include connector plugs which are inserted into sockets on the disc drive. The connector plugs are inserted and removed from sockets to selectively connect and remove the disc drive from the host system. The fit of the connector plug in the socket is relatively tight to provide a rigid connection between the disc drive and host system. The force necessary to pull the connector plug from the tight connection in the socket can loosen or damage the connector plug. The present invention addresses these and other problems, and offers other advantages over the prior art.

SUMMARY OF THE INVENTION

The present invention relates to an extraction device for removing a connector plug from a disc drive socket including first and second lever plates having a length extending between opposed first and second ends and a width extending between opposed sides and the first and second lever plates being pivotally connected between the first and second ends to form lever handles and lever arms. The lever arms include opposed fingers spaced along the width of the lever plates between opposed sides. The lever arms include a slot between fingers, a width of which is sized to enclose a length of the connector plug. A spring biases the lever arms of the first and second lever plates towards one another and the lever plates being movable against a spring bias to open the lever arms to remove a connector plug.

DETAILED DESCRIPTION OF ILLUSTRATIVE EMBODIMENTS

Figure 1:
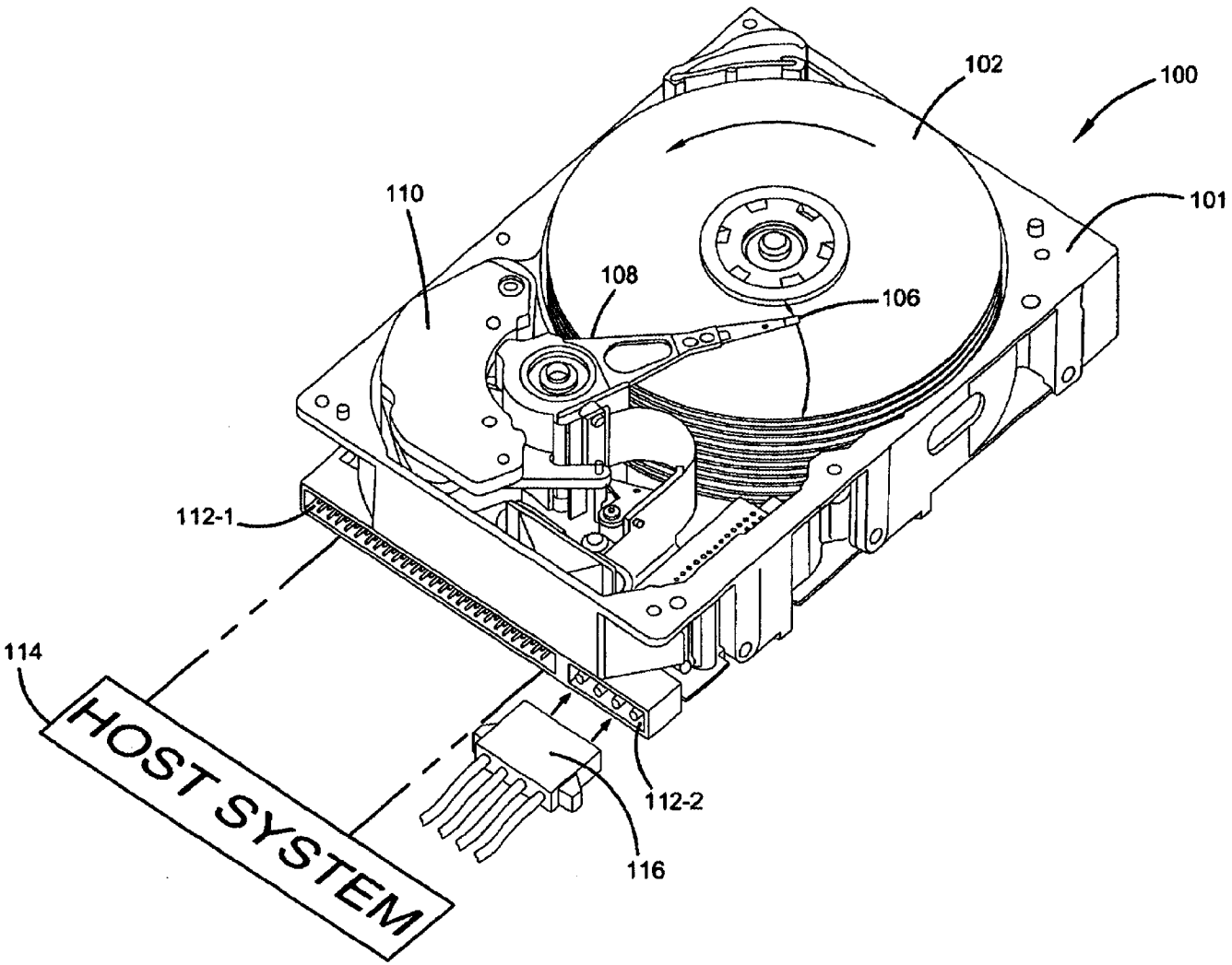
FIG. 1 is a perspective illustration of an embodiment of a disc drive including a socket having a connector plug inserted therein.

The present invention relates to an extraction device for removing a connector plug from a connector socket of a disc drive as will be explained. FIG. 1 illustrates a disc drive 100 including a chassis 101 supporting a plurality of discs 102 on a spindle motor (not shown) for rotation and data heads 106 supported by an E-block 108 rotationally coupled to the chassis 101. For operation a voice coil motor 110 moves data heads 106 to read data from or write data to selected tracks on the rotating discs 102. The disc drive includes sockets 112-1, 112-2 for external connection to a host system 114 illustrated diagrammatically. A connector plug 116 is coupled to host system 114 and is inserted into socket 112-2 to provide a power connection for disc drive components through the host system 114. Connector plug 116 is removed from the socket 112 to disconnect the disc drive from the host system 114.

The connector plug 116 is sized to snuggly fit into the socket 112 to provide a reliable host interface connection. The snug fit between the connector plug 116 and socket 112 makes it difficult to remove the connector plug 116 from the socket 112. The force used to remove the connector plug 116 from the socket 112 can loosen and damage the connection. The present invention provides a device to remove the connector plug 116 from the socket 112 to reduce damage to the connector plug 116.

Figure 2:
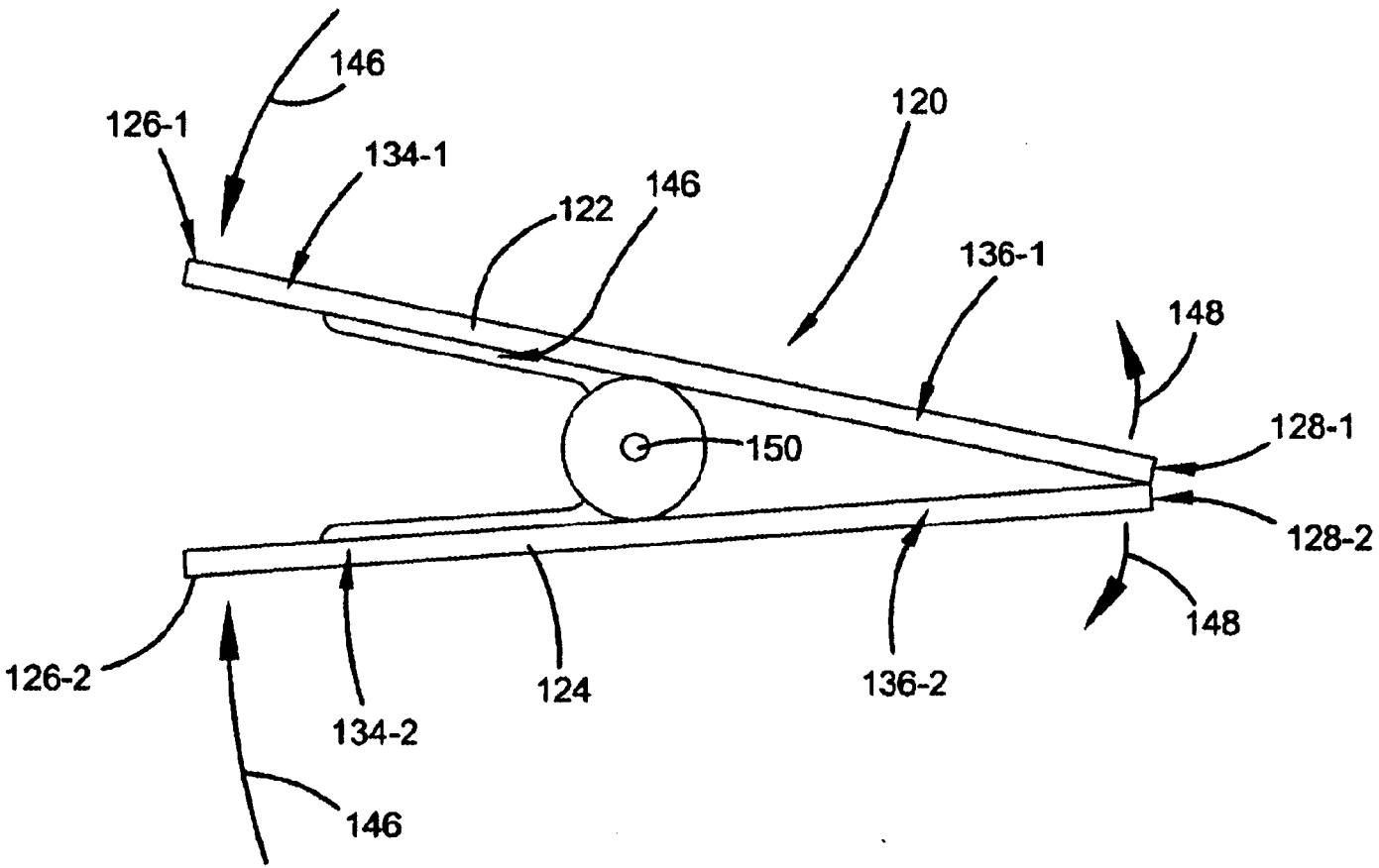
FIG. 2 is a side elevational view of an embodiment of an extraction device of the present invention.
Figure 3:
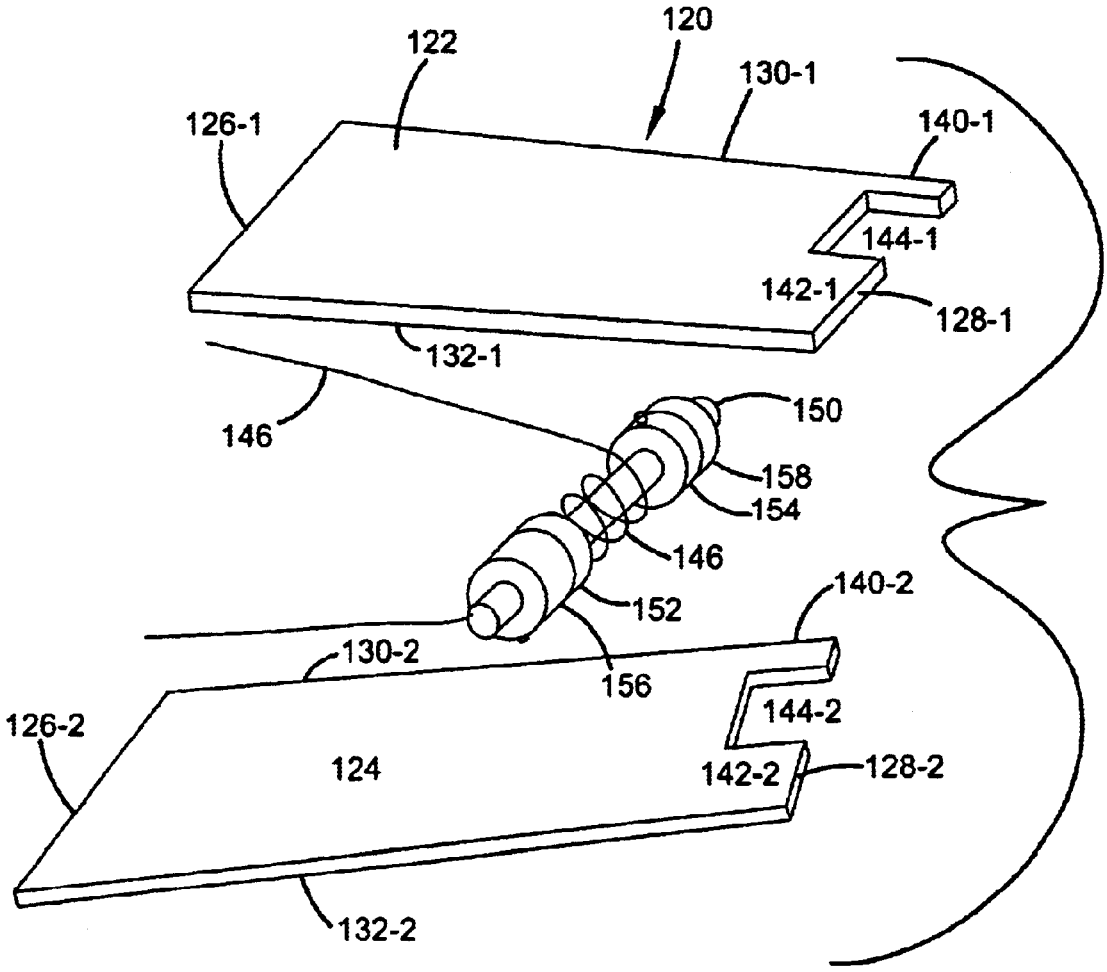
FIG. 3 is an exploded view of an embodiment of the extraction device illustrated in FIG. 2.
Figure 4:
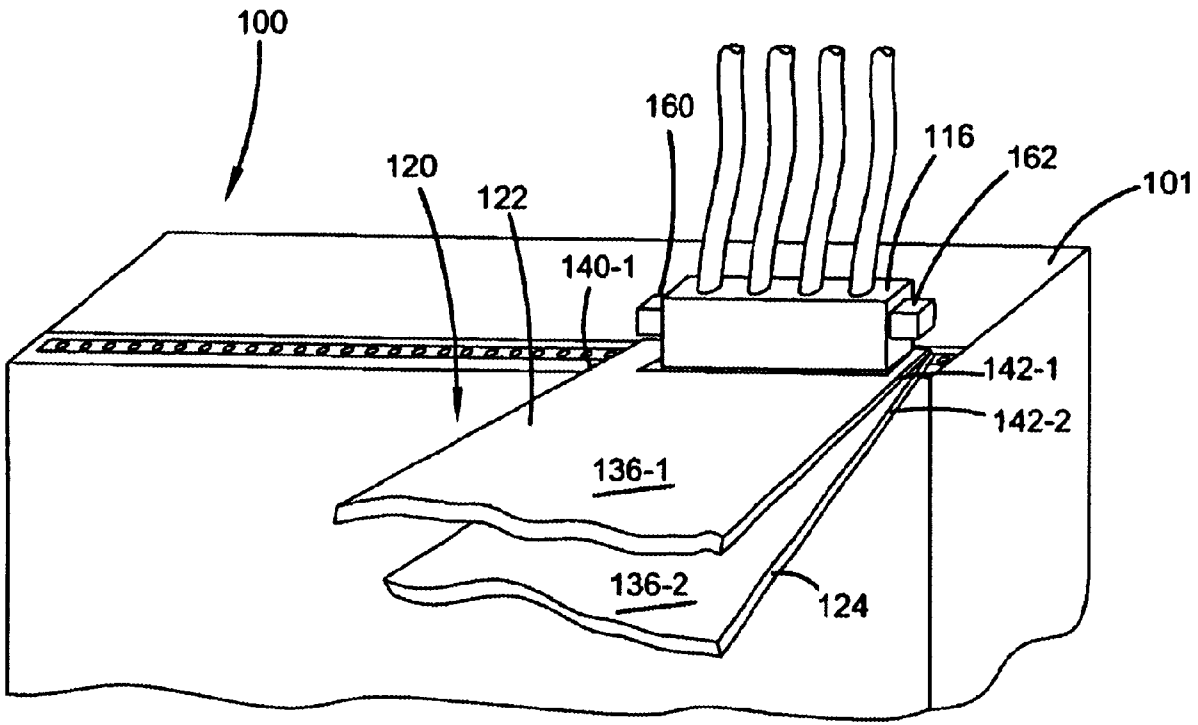
FIG. 4 is an illustration of operation of the embodiment of the extraction device of FIGS. 2–3 for removing a connector plug from a socket of a disc drive.

An embodiment of the removal device 120 is illustrated in FIGS. 2–3. The device 120 includes first and second lever plates 122, 124 having a length extending between opposed ends 126-1, 126-2 and 128-1, 128-2 and a width extending between opposed sides 130-1, 130-2 and 132-1, 132-2. The plates 122, 124 are pivotally connected between opposed spaced ends 126, 128 to form lever handles 134-1, 134-2 and lever arms 136-1, 136-2 on opposed sides of the pivot connection of the plates 122, 124 as illustrated in FIG. 2.

The lever arms 136-1, 136-2 of plates 122, 124 include opposed fingers 140-1, 142-1 and 140-2, 142-2 spaced along a width of plates 122, 124 between opposed sides 130, 132 as illustrated in FIG. 3. Plates 122, 124 include a slot 144-1, 144-2 between opposed fingers 140-1, 142-1 and 140-2, 142-2. Plates 122, 124 are normally biased via torsion spring 146 so that fingers 140-1, 142-1 and 140-2, 142-2 on lever plates 122, 124 are normally in abutting relation, as shown in FIG. 2, and slots 144-1, 144-2 on plates 122, 124 form an opening for removing the connector plug 116 from socket 112 as will be explained. For operation, as illustrated in FIG. 2, lever handles 134-1, 134-2 on plates 122, 124 are moved toward one another as illustrated by arrows 146 to separate fingers 140-1, 142-1 and 140-2, 142-2 on lever arms 136-1, 136-2 of plates 122, 124 as illustrated by arrow 148 to remove connector plug 116 from socket 112.

In the embodiment shown in FIG. 3, the plates 122, 124 are rotationally connected to a rod 150 via spaced inner and outer rings 152, 154 and 156, 158 as shown in FIG. 3. Inner and outer rings 152, 154 are rotationally coupled to rod 150. Inner rings 152, 154 are rigidly connected to plate 122 and outer rings 156, 158 are rigidly connected to plate 124 to rotationally connect first and second lever plates 122, 124 relative to rod 150. In the embodiment shown, the rod 150 extends the width of the plates between opposed sides 130, 132 and torsion spring 146 is mounted between inner rings 152, 154.

Figure 5:
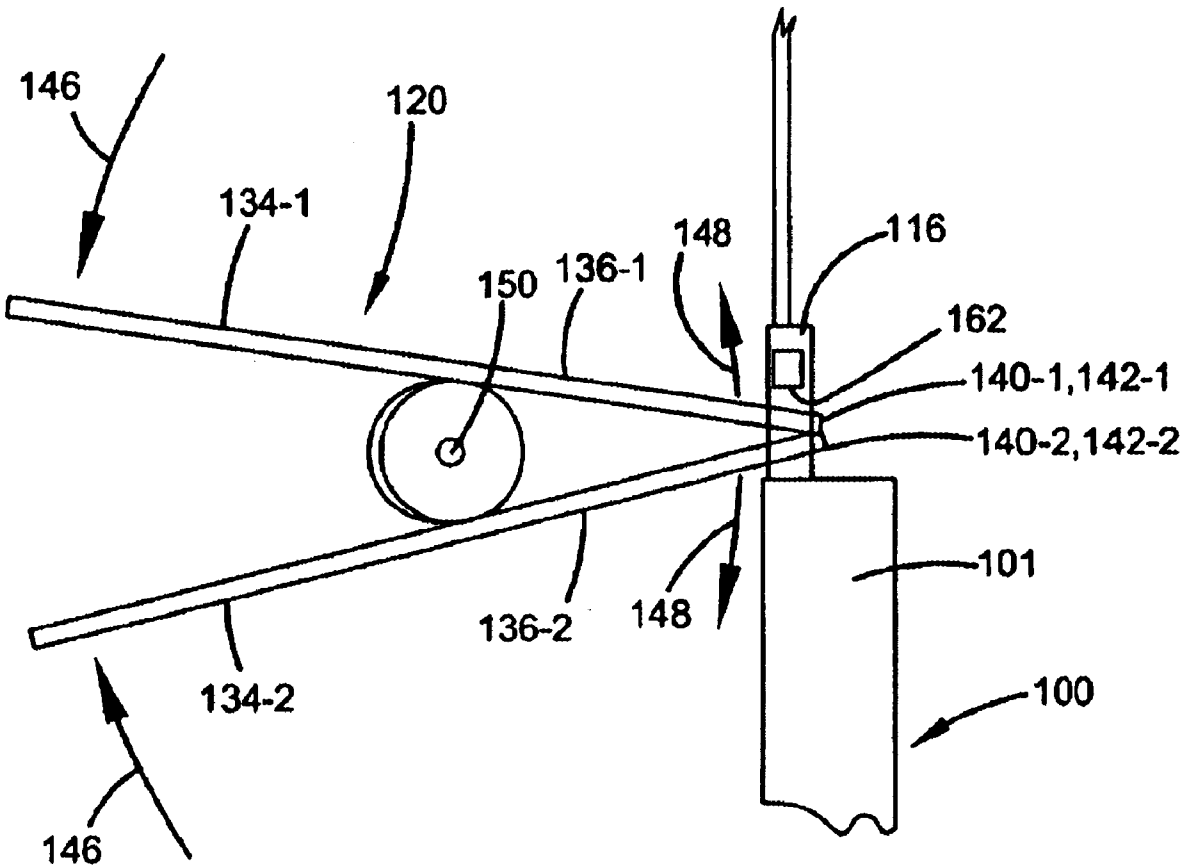
FIG. 5 is a side view illustrating removal of a connector plug by the extraction device illustrated in FIGS. 2–4.

As shown in FIG. 5, lever handles 134-1, 134-2 are rotated as illustrated by arrows 146 to rotate arms 136-1, 136-2 to separate or open fingers 140-1, 142-1 and 140-2, 142-2 on upper and lower plates 122, 124. As the fingers separate, fingers 140-1, 142-1 push or exert force against plug wings 160, 162 while fingers 140-2, 142-2 bias against the disc chassis 101 to force the connector plug 116 from the socket 112 to remove the connector plug without damage.

The diameter and placement of rings 150, 152, 156, 158 and length of the plates 122, 124 are sized to provide sufficient leverage for lever handles 134-1, 134-2 and arms 136-1, 136-2 to easily remove the connector plug 116 from the socket 112 without significant force exertion. The width of slots 144-1, 144-2 are sized to enclose the width of the connector plug 116.

Although a particular orientation and connection is shown for inner and outer rings 152, 154, 156, 158 to upper and lower lever plates 122, 124 application is not limited to the particular orientation shown. The invention is illustrated with respect to a particular connector plug 116, but it should be understood that application of the present invention is not limited to the particular connector plug 116 shown.

Figure 6:
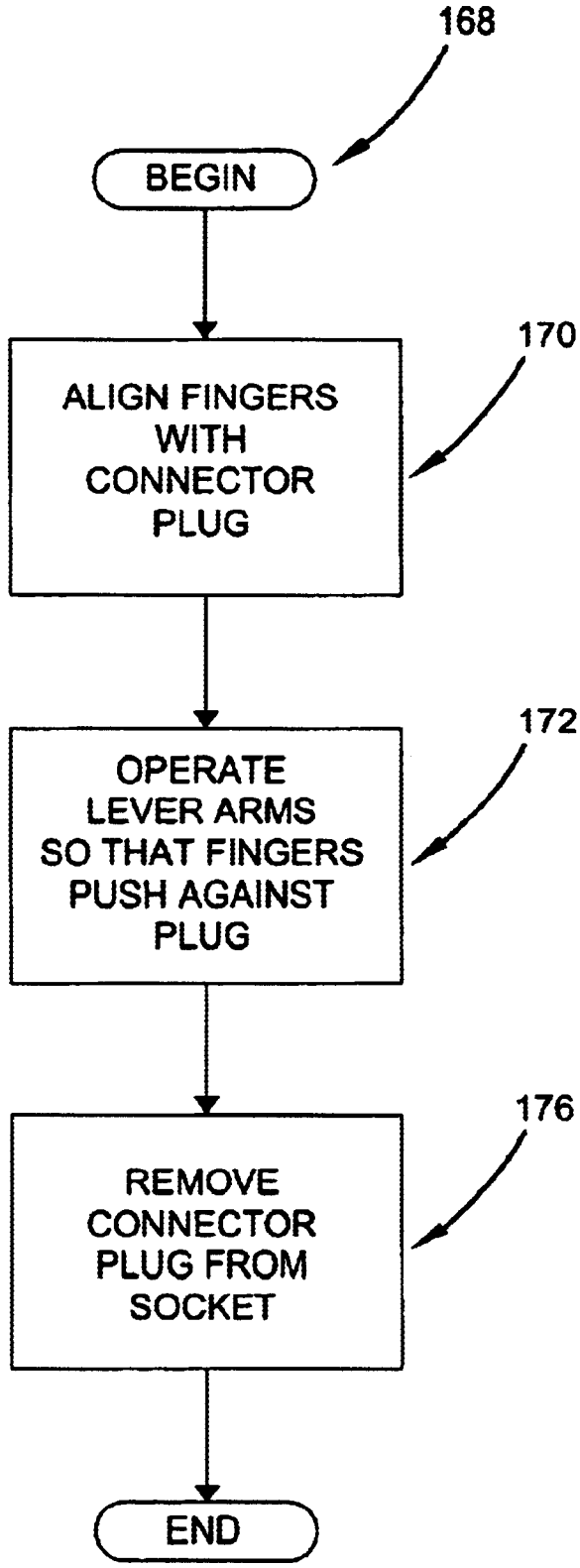
FIG. 6 is a flow chart illustrating operation for removing a connector plug from a socket of a disc drive.

FIG. 6 is a flow chart illustrating an embodiment for removing a connector plug from a socket 112 according to the present invention. As shown in FIG. 6, operation begins at block 168. For use, device 120 is aligned so that connector plug 116 is in opening form by slots 144-1, 144-2 with fingers 140-1, 142-1 and 140-2, 142-2 aligned with connector plug wings 160, 162 and chassis 101 as illustrated by block 170. The device is operated to separate fingers 140-1, 142-1 and 140-2, 142-2 to engage connector plug as illustrated by block 176 to remove the connector plug 116 as illustrated by block 176.

An extraction device 120 for removing a connector plug 116 from a disc drive socket 112 including first and second lever plates 122, 124 having a length extending between opposed first and second ends 126-1, 126-2 and 128-1, 128-2 and a width extending between opposed sides 130-1, 130-2 and 130-2, 132-2 of the first and second lever plates 122, 124. The lever plates 122, 124 being pivotally connected between the first and second ends 126-1, 126-2 and 128-1, 128-2 to form lever handles 134-1, 134-2 and lever arms 136-1, 136-2. The lever arms 136-1, 136-2 include opposed fingers 140-1, 140-2 and 142-1, 142-2 spaced along the width of the lever plates between opposed sides 130-1, 130-2 and 132-1, 132-2. The lever arms 136-1, 136-2 include a slot 144-1, 144-2 between fingers 140-1, 142-1 and 140-2, 142-2, a width of which is sized to enclose a length of the connector plug 116. A spring 146 biases the lever arms 136-1, 136-2 of the first and second lever plates 122, 124 towards one another and the lever plates 122, 124 are movable against a spring bias to open the lever arms 136-1, 136-2 to remove a connector plug 116.

It is to be understood that even though numerous characteristics and advantages of various embodiments of the present invention have been set forth in the foregoing description, together with details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. For example, the particular elements may vary depending on the particular application while maintaining substantially the same functionality without departing from the scope and spirit of the present invention. In addition, although the preferred embodiment described herein is directed to a magnetic disc drive system, it will be appreciated by those skilled in the art that the teachings of the present invention can be applied to other systems, like optical or magneto-optical systems, without departing from the scope and spirit of the present invention.

What is claimed is:

1. An extraction device for removing a connector plug from a data storage device comprising:

first and second lever plates having a length extending between opposed first and second ends and a width extending between opposed sides and the first and second lever plates being pivotally connected between the first and second ends to form lever handles and lever arms and the lever arms including opposed fingers spaced along the width of the lever plates between the opposed sides and including a slot between the opposed fingers having a slot width adaptively sized relative to a width of the connector plug and the fingers including an engagement length extending along a length portion of the first and second lever plates to an engagement edge at the second end of the first and second lever plates and the opposed spaced fingers having a profile along the engagement length to the engagement edge to adaptively position the fingers between a portion of the connector plug and the data storage device; and a spring biasing the lever arms of the first and second lever plates towards one another and the first and second lever plates being movable against the spring bias to adaptively open the lever arms to remove the connector plug.

2. The extraction device of claim 1 wherein the spring is a torsion spring.

3. The extraction device of claim 1 and including a rod and the first and second lever plates are connected to rings rotationally coupled to the rod.

4. The extraction device of claim 3 wherein the rod extends between the opposed sides of the first and second lever plates.

5. The extraction device of claim 4 wherein the rings include opposed spaced inner and outer rings extending along a length of the rod to pivotally connect the first and second lever plates.

6. The extraction device of claim 5 wherein the inner spaced rings are coupled to the first lever plate and the outer spaced rings are coupled to the second lever plate.

7. The extraction device of claim 5 wherein the spring includes a torsion spring between the opposed spaced inner rings.

8. The extraction device of claim 1 wherein the first and second lever plates are formed of a metal material.

9. The extraction device of claim 1 wherein the fingers are spaced to abut wings extending from a body portion of the connector plug.

10. An extraction device for removing a connector plug from a socket of a data storage device comprising:

extraction surface means for insertion between the connector plug and the data storage device for removing the connector plug from the socket; and means for exerting an extraction force relative to the extraction surface means to extract the connector plug from the socket.

11. The extraction device of claim 10 wherein the extraction surface means includes opposed spaced fingers spaced to abut extended portions of the connector plug and the means for exerting the extraction force supplies the extraction force through the spaced fingers to extract the connector plug from the socket.

12. The extraction device of claim 10 wherein the means for exerting the extraction force includes extraction arms including the extraction surface means rotatable against a spring bias to provide the extraction force for extracting the connector plug from the socket.

13. The extraction device of claim 10 wherein the means for exerting the extraction force includes opposed extraction handles operable to rotate the extraction surface means against a spring bias to provide the extraction force.

14. The extraction device of claim 13 wherein the extraction surface means includes opposed spaced fingers separated by a slot.

15. The extraction device of claim 14 wherein the fingers are spaced to abut wings extending from a body portion of the connector plug.

* * * * *